United States Patent [19]

Williamson

[11] 4,353,235

[45] Oct. 12, 1982

[54] EDGE PREFORMING OF METAL PLATE

[75] Inventor: Calvin C. Williamson, Napa, Calif.

[73] Assignee: Kaiser Steel Corporation, Oakland, Calif.

[21] Appl. No.: 160,390

[22] Filed: Jun. 17, 1980

[51] Int. Cl.[3] ..... B21B 1/04

[52] U.S. Cl. ..... 72/130; 72/203; 72/181

[58] Field of Search ..... 72/51, 52, 129, 130, 72/131, 132, 176, 177, 178, 179, 181, 203, 368; 228/146, 147, 149, 151, 173 B

[56] References Cited

U.S. PATENT DOCUMENTS

| | | | |
|---|---|---|---|
| 735,936 | 8/1903 | Blakey et al. | 72/129 |
| 2,098,989 | 11/1937 | Yoder | 228/151 |
| 3,606,671 | 9/1971 | Pearson | 228/151 |
| 3,765,211 | 10/1973 | Struss | 72/181 X |
| 4,148,426 | 4/1979 | Midzutani et al. | 228/146 |

FOREIGN PATENT DOCUMENTS

| | | | |
|---|---|---|---|
| 664582 | 9/1965 | Belgium | 228/151 |
| 2307134 | 8/1974 | Fed. Rep. of Germany | 72/178 |
| 2916928 | 11/1979 | Fed. Rep. of Germany | 228/147 |
| 138557 | 12/1952 | Sweden | 72/129 |

*Primary Examiner*—Ervin M. Combs
*Attorney, Agent, or Firm*—James E. Toomey

[57] ABSTRACT

Method and means for preforming the long edges of steel plate prior to manufacture into pipe by the U-O Process or the like by utilizing plate of a width exceeding that required for pipe of a given diameter by an amount at each edge having an excess at least equal to the width of the pipe. Roll-forming the plate to use the excess width thereof as a lever arm to obtain a bend at the bitter edges of the pipe (edges required for pipe) of a radius required for the pipe and thereafter shearing the plate to form the bitter edges, followed by bevelling and polishing the bitter edges, and further roll-forming the edge area to complete the preform thereof.

9 Claims, 28 Drawing Figures

EDGE PREFORMING OF METAL PLATE

BACKGROUND OF THE INVENTION

Field of the Invention

This invention relates to a method and related equipment for performing the edges of sections of strip or plate prior to forming and welding them into large diameter pipe. It is particularly useful for pipe made from thick gauge plates according to the so-called U-O process.

The U-O process for making large diameter pipe was developed primarily to produce pipe used in the oil and gas industry to transport these products over long distances. It is not unusual for such pipe line to be several hundreds of miles long. The ever increasing demand for these energy related products makes it desirable to transport them through pipe lines at much higher pressures and over a broader range of geographical temperature conditions. This requires pipe wall thicknesses in excess of one inch and in grades of steel that are very hard to form.

By the U-O pipe making system individual sections of flat steel plate or strip that are cut to length are formed into U-shaped sections by a hydraulic press or the like which is known as a U-Press. The U-shaped section of strip or plate is then subjected to a so-called O-Press operation wherein another press, also usually of the hydraulic type, forms the section into an O-shape approximating the final configuration of the pipe. Such section or pipe unit is thereafter welded or otherwise sealed by conventional methods at its abutting edges. Typical examples of U-Presses and O-Presses disclosing the system referred to above are U.S. Pat. Nos. 2,591,085 and 2,588,325.

One of the most difficult and costly problems in forming pipe sections or units by the U-O system, and particularly from heavy gauge metal, is that of forming of the edges along the length of the section that each edge is formed to the proper radius to the bitter edge to conform to the desired over all diameter of the pipe section. The normal practice is to preform the edges of the section to be formed into pipe prior to subjecting the section to the U-Press or O-Press operation. With the employment of heavier gauge plate sections and hard to form grades of steel, the preforming of the edges by systems now in use have become a difficult and expensive operation requiring high capital expense and cumbersome crimping and forming equipment.

The usual practice in forming large diameter pipe from a section of plate is to cut the plate section to the required width for the ultimate pipe diameter. Thereafter, edge planers, planishing rolls or other means may be used to bevel the edges or "noses" of the long edges of the plate section while it is still flat so that such edges are of a suitable shape for welding following the U-O pipe-making operation. The plate section edges are then formed to the radius of the finished pipe. This is done by passing the plate edges between edge crimping rolls with the proper radius as closely as possible by heavy presses (generally hydraulic) fitted with properly contoured dies. On heavy plate, these methods cannot bend the plate to the extreme edge since the principle involved in plate bending requires that some of the plate edge be used as a lever arm to attain the requisite bending moment to bend the plate. Under such conditions the width of the plate edge that acts as the lever arm to bend the plate adjacent to the bend remains as an unbent flat edge. The width of this flat edge is dependent upon the strength of the crimping rolls or press which exerts the force required to bend the plate. In order to reduce the length of the remaining lever arm, that is the area that functions as a lever arm, the bending forces exerted must be materially increased to obtain and maintain the requisite bending moment. This manner of attaining reduction in the length of the lever arm is limited by the outermost edge of the crushing resistance of the plate to the increased forces. Presses built to exert such forces are very expensive and they still fall short of providing the ideal edge bend conditions.

Conventional methods of bending or crimping the edges of plate or strip are consequently not effective adjacent the bitter edges of a plate section. There remains a defective, flat area at each edge approximating the thickness of the plate. This is the area that cannot be bent. In fact the required forces to do so would cause crushing of the plate. Consequently, thicker plates result in wider and longer unformed areas or regions which cause a defective pipe contour when the edges of the plate section are brought together for welding following the U-O operation. The flat area adjacent to the edge of the welded seam of the pipe results in a peaked contour which is undesirable and can lead to defects such as "toe cracks" on the inside weld of the pipe when operated under pressure.

Description of Prior Art

In prior art U-O pipe making operations, it has always been the practice to first trim plate or sections to a width corresponding to the diameter of the pipe which is ultimately to be formed. In other words, the sections of metal to be formed into pipe are first cut and planed to a width that is the same as the periphery of the pipe to be formed.

Typical examples of prior art wherein edge bending has been practiced by roll-forming has been confined to strip or other relatively thin gauge metal under 1" thick. Typical of this practice is U.S. Pat. No. 3,635,064 to Chang where the edge or the pipe sections are edge formed after the strip has been partially formed. The strip for the tube or pipe is cut to the required width to suit the diameter of the tubing or pipe prior to introduction to the mill and any forming operation. No suggestion is made for slitting or cutting the edges of the strip or plate after forming commences.

U.S. Pat. No. 3,794,409 discloses edge bending strip prior to formation of helical pipe. The object is to compensate in advance for the ultimate edge distortion which occurs in the fabrication of helical pipe. Helical pipe is not made by the U-O process and is not subject to U-ing and O-ing operations and plate sections are formed into different shapes.

There are other examples in the prior art showing other methods of bending the edges of skelp or strip. However, it is apparent that in such instances, prior to any forming, the section or work is sheared to a width intended to provide pipe or tubing of the diameter ultimately desired. U.S. Pat. No. 3,430,475 to Lindmark is to tubing that is first roll formed into a shape approaching the final product prior to any edge bending operation. Another patent, U.S. Pat. No. 4,122,696, discloses the practice of holding the edges in contact with the finishing rolls to avoid warping as the material passes through U-ing and O-ing roll-forming operations. The edge bending is not a separate preforming operation.

SUMMARY OF THE INVENTION

This invention relates to a method of preforming the edges of separate sheared flat metal sections of plate or strip for use in the U-O system for manufacturing large diameter steel pipe. The edges along the length of the sections of metal plate are passed through a preforming roll prior to edge trimming to obtain a section of a width with a radius required for the ultimate diameter of the pipe to be made by the U-O process. This preforming roll pass is conducted by utilizing excess edge material on the flat plate so that in the edge preform pass such excess functions as a lever arm to bend metal adjacent to it and to minimize the roll separating forces during the bending operation that takes place during rolling. The plate with the so-formed edges is passed through slitter blades or other shearing equipment to cut it to the required width for the pipe diameter ultimately desired wherein the cut is made in the outermost portion of the bent section, thus leaving the trimmed plate bent to its bitter edge. Bending is therefore accomplished with only moderate bending pressures eliminating the undesirable tendency to crush the edge rather than bending it. After trimming to width the edges may also be bevelled and planed and passed through additional edge preforming rolls to further increase the width of the formed edge to reduce the forces subsequently required for forming in the O-Press. After the edges are so preformed the plate section is then formed into a "U" shape in a U-Press and then into an "O" shape in the O-Press and thereafter welded.

The concept or retaining the untrimmed scrap on the edge of the plate through at least the first preforming or crimping pass before it is removed has not heretofore been utilized. It has been the practice in the art to always trim the plate section to a width corresponding to the ultimate pipe diameter prior to edge preforming.

DESCRIPTION OF DRAWINGS

The method and means for carrying out the present invention and its significance will be more apparent by reference to the accompanying drawings relating to the preferred embodiment of the invention and a desirable alternative well suited for use with thick plate sections, wherein:

The FIG. 1 series of drawings shows an arrangement for initial preforming of the edges of the plate and shearing the excess edge material from the long edges. In this series

The FIG. 2 series of drawings shows an alternative arrangement for carrying out the invention. In this series

FIG. 4A is a view partly in section of a plate before the preform and shearing step. FIGS. 4B and 4C are detailed fragmentary views partly in section showing planishing rolls which separately bevel the corners of the bitter edge of the plate. FIG. 4D is a similar view showing a standard planing operation;

DETAILED DESCRIPTION OF INVENTION

Figure 1A:
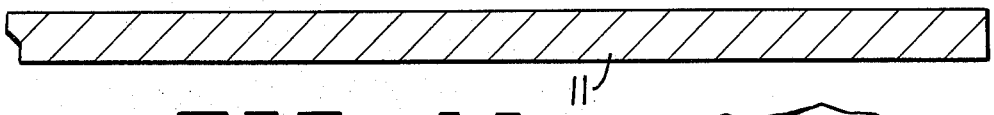
FIG. 1A is a section through the plate to be edge preformed and sheared at the long edges.

Referring now to the drawings wherein 11 is a heavy gauge plate having a width as received from the plate mill exceeding that required for the diameter of the pipe into which it is to be formed. Generally, such plate sections have approximately one inch excess width extending alone each of its longitudinal edges, or an excess width X at each longitudinal edge which at the least is equal to the thickness of the plate. The excess may vary from one plate manufacturer to another depending upon manufacturing practices and customer preferences. Plate 11 in each of FIGS. 1A through 1E is shown in cross section in order to depict the shape of the edges of the plate at various stages of the forming operation constituting the first embodiment of the process of the invention herein described.

Figure 1B:
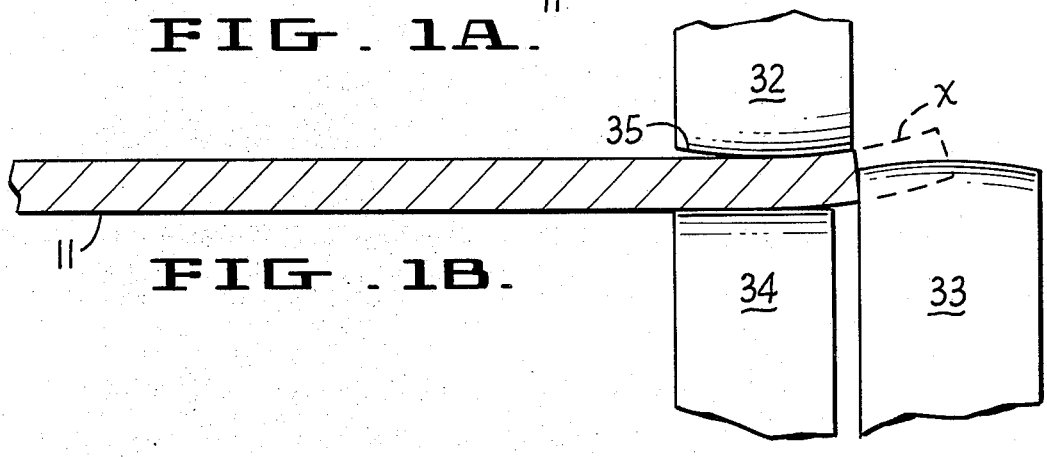
FIG. 1B is a fragmentary detail view partially in section of one edge of the plate wherein upper and lower shear rolls cooperate to preform the plate edges and also to shear them at the bitter edges.
Figure 1C:
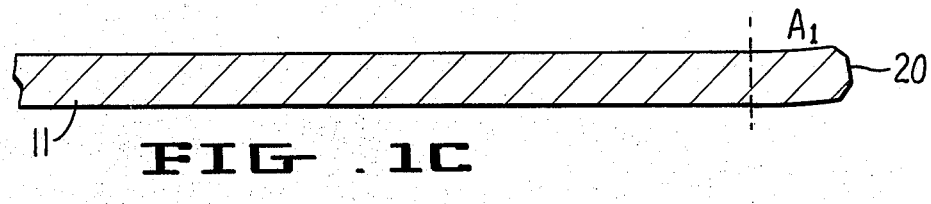
FIG. 1C is a section of the sheared preformed plate after it has been subjected to edge bevelling by planishing or cutting as shown in FIGS. 4B and 4C, and FIG. 2D, respectively.
Figure 1D:
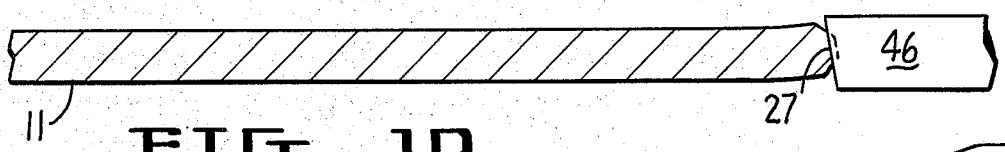
Figure 1E:
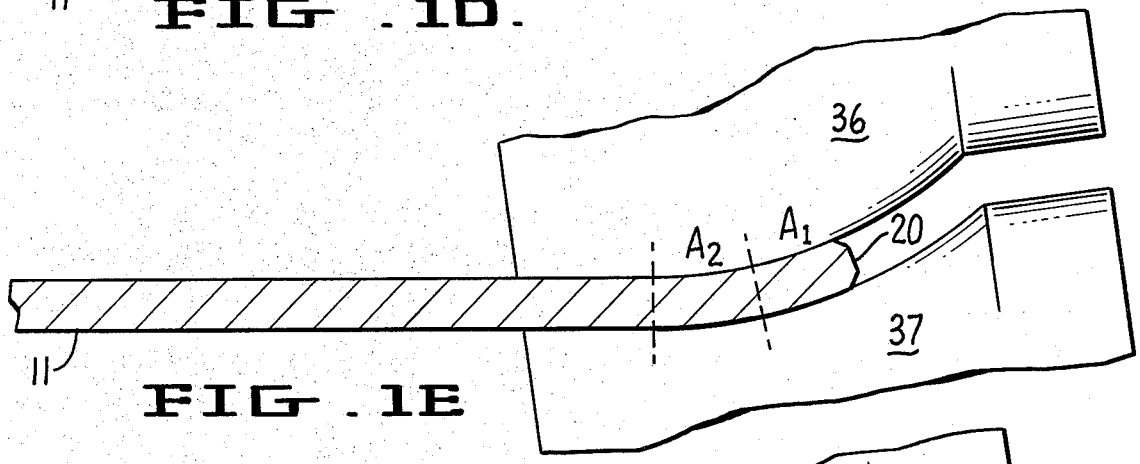
Figure 1F:
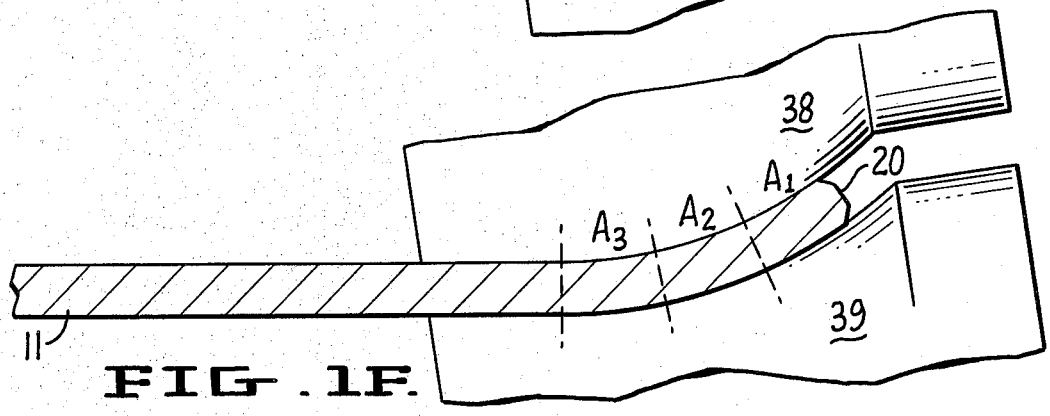

By the means and method for edge preforming shown in FIGS. 1A through 1F, inclusive, each of the edges of plate 11 are passed through preform and shearing rolls 32 and 33 as shown in FIG. 1B. Shearing roll 32 has a face 35 with a contour at both sides of the center of the blade corresponding to the crimp required at the area adjacent the bitter edge of plate 11, that is, the contour corresponds to the finished radius required for the plate. The backup roll opposite the top blade is flat and cooperates to force the plate against the bearing surface of top blade 32 to support the reaction to shearing of bottom shear blade 33 and the excess edge material of the plate serves as a lever arm until bottom blade 33 shears the excess edge material at the bitter edge. Bottom blade 33 is advantageously contoured at its face to the same extent as top blade 32 so that they will be interchangeable and rotatable. After the combined preforming and shearing step the plate 11 is edge bevelled and nose 27 thereof is shaved by planer 46, all in the conventional manner as shown in FIGS. 1C and 1D and hereinafter described. Thereafter the plate 11 is passed through further edge preforming rolls as shown in FIGS. 1E and 1F. The upper and lower rolls 36 and 37 of FIG. 1E are shaped to form segments of crimped area along the plate of the desired finished radius. This arrangement prevents any tendency to flatten the precrimp radius as it was generated in the preforming and sidetrimming step of FIG. 1B. Rolls 38 and 39 in FIG. 1F cooperate in similar fashion to provide a larger segment of preformed edge surface. As in the case of FIG. 1E, rolls 38 and 39 also are of a uniform radius corresponding to that of the desired finished radius.

Advantageously the length of the preform utilizing the excess edge material is kept to a minimum to assure that it attains the finished radius. However, the length of the shaped areas formed during each preform pass may vary or may be approximately equal. For example, area A, formed during the precrimp can be of about the same length as each of lengths $A_2$ and $A_3$ formed on the successive preform rolls following the bevelling and edge shaving steps. Accordingly, it is feasible to preform the edge areas to different radii so long as the final preform roll brings the edges to the desired final radius without distoring the initial preform crimp.

It is also to be understood that opposite edges of plate 11 are simultaneously preformed, trimmed and otherwise worked so that such opposite long edge of plate 11 is similar to that shown in the FIG. 1 series of drawings, as is the equipment employed.

Figure 2A:
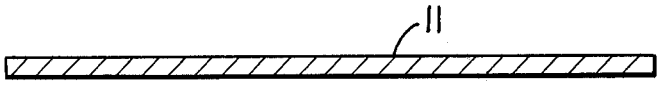
FIG. 2A is a view in section of heavy gauge plate.
Figure 2B:
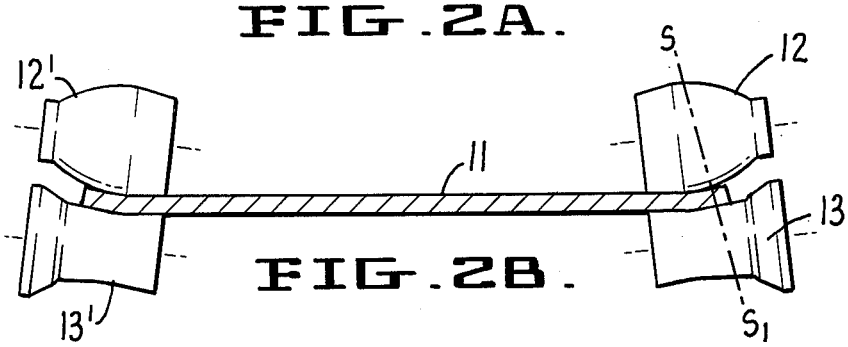
FIG. 2E is a similar view of a fragment of a planing toll for scraping the edges of the preformed plate.
FIGS. 2F and 2G are similar views of further edge preform roll operations wherein the plate edges are rolled to extend the amount of edge curvature from a direction away from the bitter edge of the plate toward the center line of the plate at a radius desired for the final diameter of the pipe.
Figure 2C:
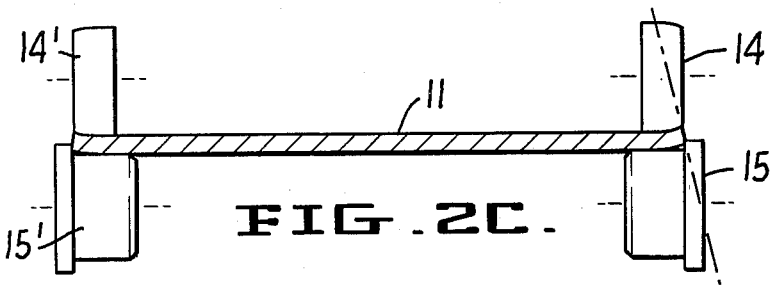
Figure 2D:
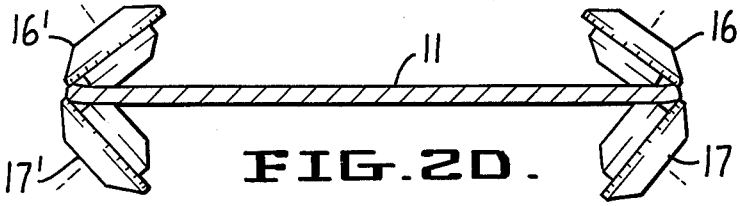

FIGS. 2A through 2F shown the treatment of the plate across its width and is a useful alternative arrangement for practicing the invention, particularly for heavy gauge plate. By this mode rolls 12, 13 and 12' and 13' are cooperating upper and lower edge preforming rolls through which the mill width plate section 11 is passed in the first step of the process. S and S' as shown in FIGS. 2B and 2C are the shear line in the outermost portion of the bent area along which plate 11 is cut in the operation depicted in FIG. 2C.

14 and 15, 14' and 15' are cooperating upper and lower cutter elements which are designed to trim the edges of the plate at lines S—S' as it passes through the slitters wherein the bitter edges of the plate are formed. For the purposes of this invention and as used herein the term "bitter edge" means the outermost machined or sheared edge of plate 11 or of any other plate to be preformed.

Figure 2E:
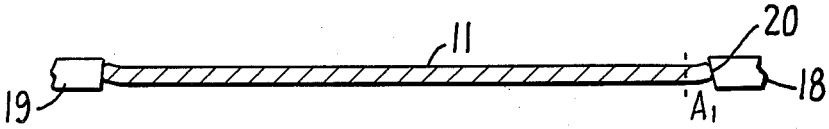

Shear elements 16 and 17, and 16' and 17' are upper and lower edge bevel shears positioned on the mill after the edge cutters and are designed to bevel the bitter edges of plate 11 as it passes through the mill. Other means may be used for bevelling such as planishing rolls, and planer cutters, such as described hereafter and in FIG. 4. Planing elements 18 and 19 are shown in FIG. 2E and function to polish the extreme outer end or "nose" 20 of plate 11 at the bitter edges.

Figure 2F:
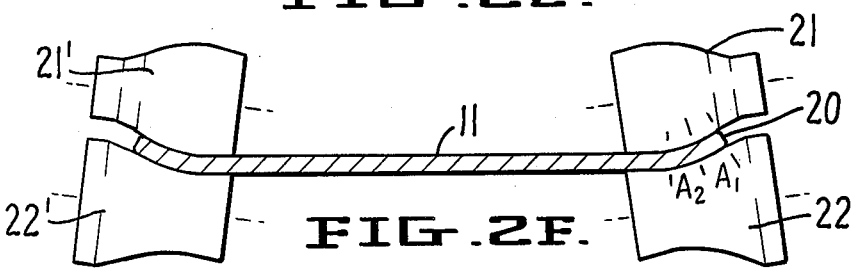

Rolls 21 and 22 and 21' and 22' of FIG. 2F are upper and lower rolls, respectively, designed to further bend and preform the edges of plate 11 to widen the curved edge after the shearing and edge bevelling steps. Rolls 23 and 24 and 23' and 24' of FIG. 1G are final edge bending rolls for more completely bending the pipe edges to the desired radius, over the widened area.

It will be noted that the rolls shown in FIGS. 1E and 1F, FIGS. 2F and 2G, are at an angle with the horizontal, that is they are advantageously skewed, to conform and adjust to the final desired radius of the pipe and thereby reduce the differential diameters occurring in the surface of a forming roll. However, if desired the rolls may be left with their axes on the horizontal.

The present invention may be employed with any metal, but for obvious commercial reasons steel is the metal used in practically all instances. Although it is particularly useful for thick gauge steel material of one inch or more and of a hardness normally used in forming large diameter U-O pipe in oil pipelines, it can be used on sheet, strip or plate of greater or lesser gauge and of varying hardness or temper.

Figure 3A:
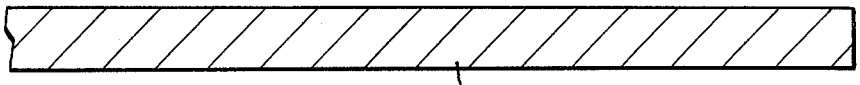
FIGS. 3A through 3G, respectively, are detailed fragmentary views of one of the ends of the plate section as it passes through the operations corresponding to the operations of FIGS. 2A through 2G, respectively.
Figure 3B:
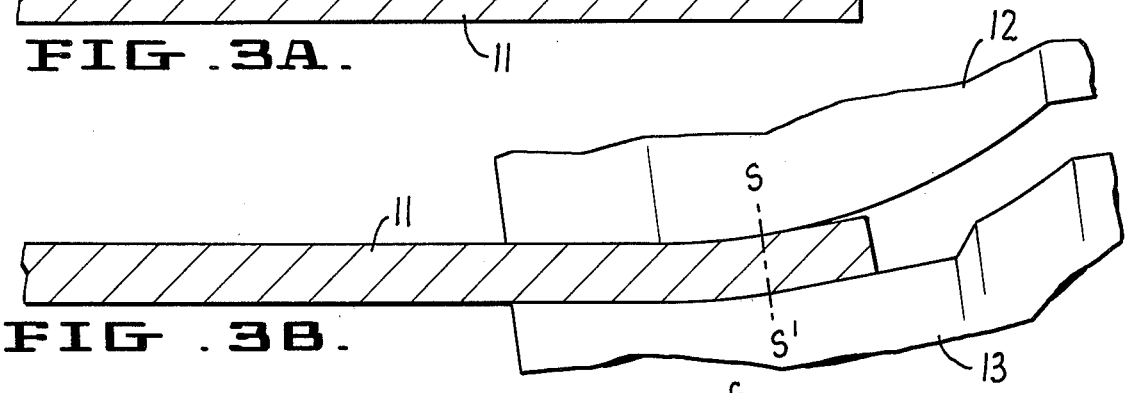
Figure 3C:
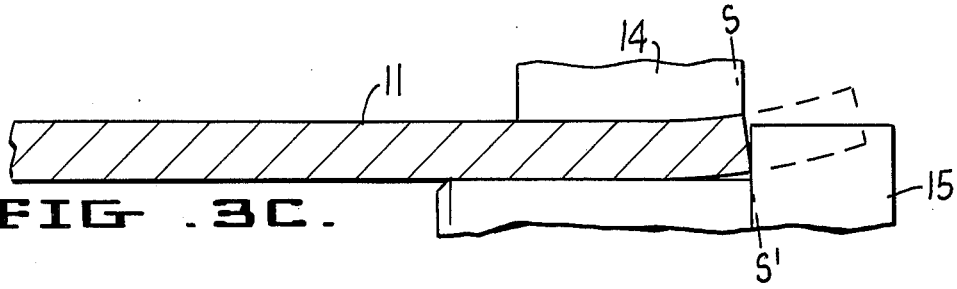
Figure 3D:
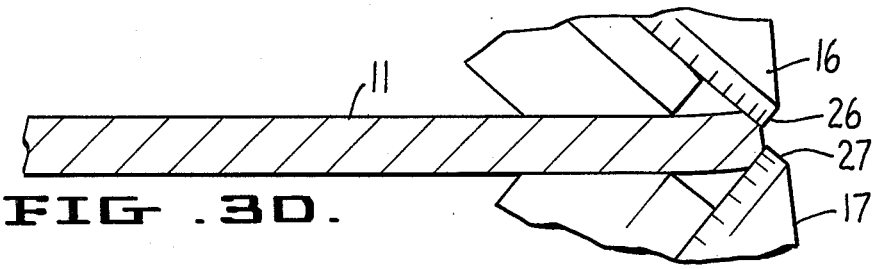
Figure 3E:
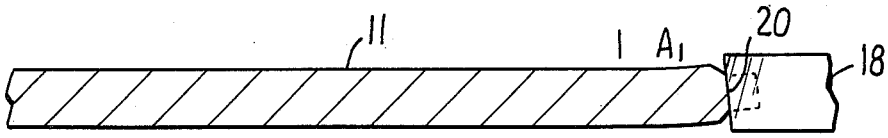

The method of operation of the process of the invention can be more completely understood by the following example of the invention as applied to a metal plate section having a thickness of one and one-quarter inches and a width exceeding that required for the ultimate circumference of the pipe after it is formed in the U-O process. Such a width might be about 42½ inches with an excess of about one and one-quarter inches at each edge of areas X. The plate is about forty feet in length. In this example at the point shown in FIG. 3B, the contact with upper roll 12 in the first preform operation is about one and three-quarter inches wide on a twelve inch radius and extends for about 1¼ inches beyond shear line S—S'. Plate 11 is pressed against upper roll 12 by pressure exerted on the lower preform operation as shown in FIG. 3B. The effect of such a rolling operation is to permit the excess edge material which remains on the plate to function as a lever arm to effect bending of the plate in the area of contact with the upper roll 12. A secondary benefit is to minimize the roll separating forces during the bending step of the first preform.

In the foregoing operation, that is the first edge preforming pass as described in FIG. 2B and FIG. 3B the bending to the desired radius does not extend to the extreme edges of the plate because a substantial portion of the plate edges are to be sheared at the bitter edge as described below.

The foregoing and the further edge preform steps are shown in detail in FIGS. 3A through 3G, which correspond to the respective steps of FIGS. 2A through 2G and show only one edge thereof.

The section is then passed to a slitting or shearing operation (see FIG. 3C) wherein the edges are trimmed to form the bitter edges, which is this example results in a 40 inch plate width as required for the diameter ultimately desired for the pipe to be formed. This shearing occurs along shear lines S—S' and is carried out by top slitter blade 13 and its cooperating bottom slitter blade 15. The sheared plate section is then sent to the bevel shears 16 and 17 wherein respective rotary shears 24 and 26 plane the corners of plate 11 to form bevelled edges on plate 11. Planing tools of conventional design are used in the nose planing operation of FIG. 1D, FIG. 2E and FIG. 3E. The purpose of these nose planing operations is to remove burrs or flashing on the bitter edge and to trim the nose to the exact size as needed for the pipe being manufactured.

There are other types of equipment for forming pipe edges as required. One alternative process is by planishing and is shown in FIG. 4B and FIG. 4C and is described hereinafter.

Figure 3F:
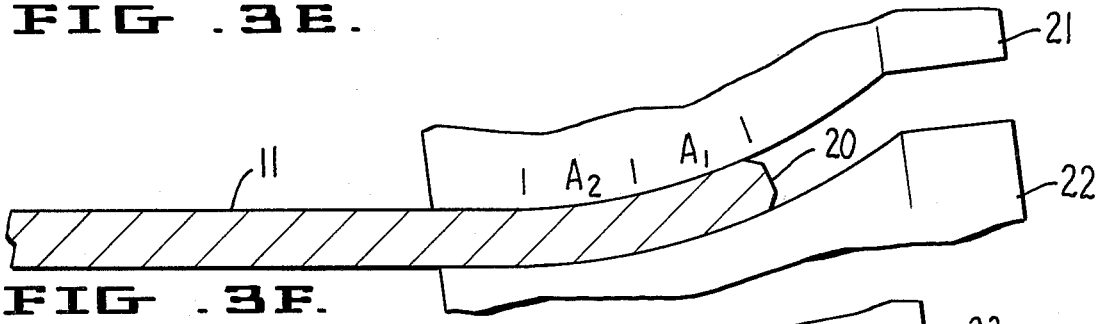
Figure 3G:
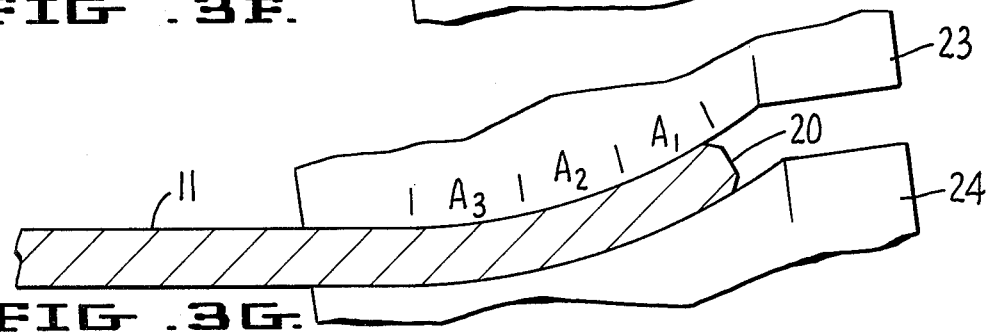

The plate section 11 then progresses through the second and the final preform operations as shown in FIGS. 3F and 3G, respectively. In the second preform the effective bending radius which is applied through upper roll 21 and lower roll 22 is the same as the first preform radius.

The final preform is carried out by passing plate 11 through upper roll 23 and lower roll 24 which brings the edges of the plate section to the finally desired radius over an area considerably wider than the width of the bend made in the first preform rolls 12 and 13. The second and final preform rolls shown in FIGS. 3F and 3G, as well as their counterpart rolls at the opposite edges of the plate at each roll station are shown as angled or skewed upwardly for the reasons discussed above.

Figure 4A:
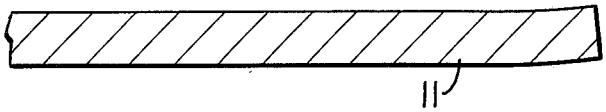
FIGS. 4A through 4D illustrate an alternative method of bevelling and planing the edges of the plate after the first preform roll and shearing of the long edges of the plate to trim excess edge material.
Figure 4B:
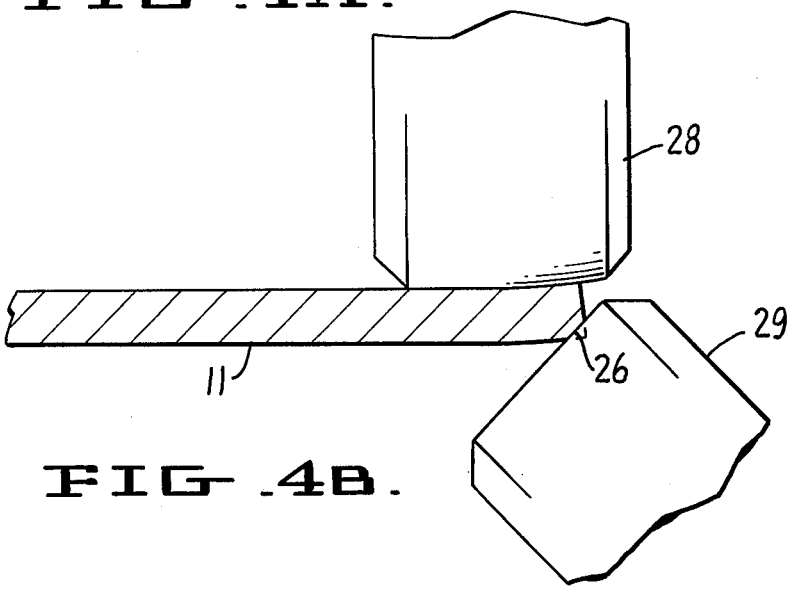
Figure 4C:
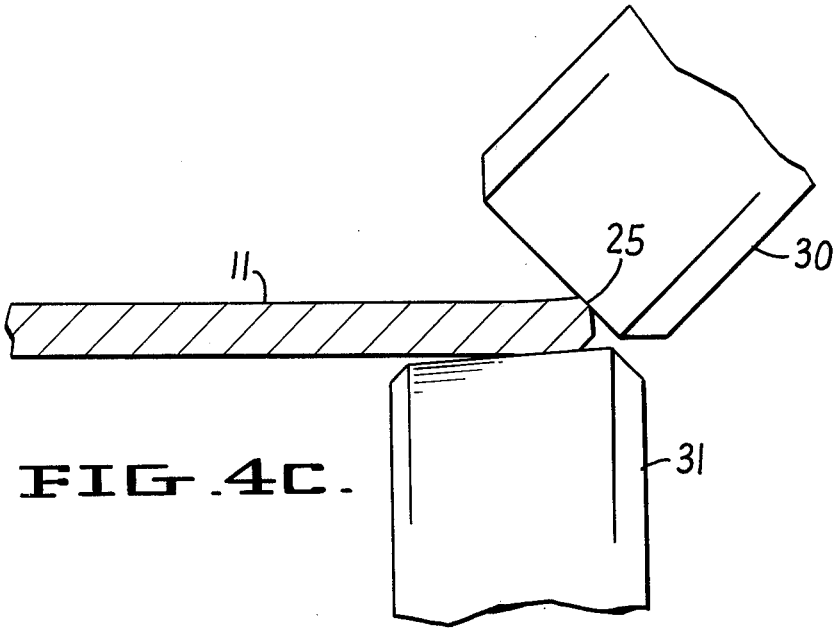
Figure 4D:
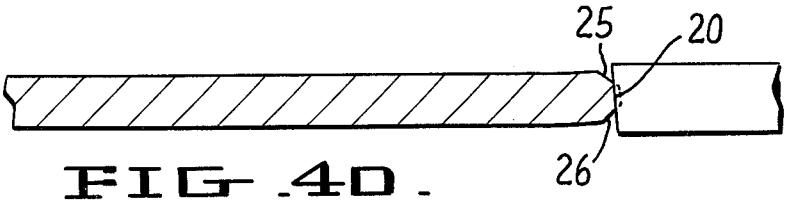

Attention is also called to the planishing roll arrangement disclosed in FIGS. 4A through 4B, inclusive, which is an alternative form of apparatus for bevelling the bitter edges of plate 11 or the like. These rolls function to compress and shape the metal in the area of the bevelled edge rather than to cut or plane it. By this arrangement plate 11 is subjected at its corners to compressive forces exerted by planishing rolls 29 and 30 while back up rolls 28 and 31 cooperate to resist the compression and improve the properties of the metal adjacent the bitter edges. The nose 20 is then shaved in the conventional manner as shown in FIG. 4D.

Figures 6, 7, 8:
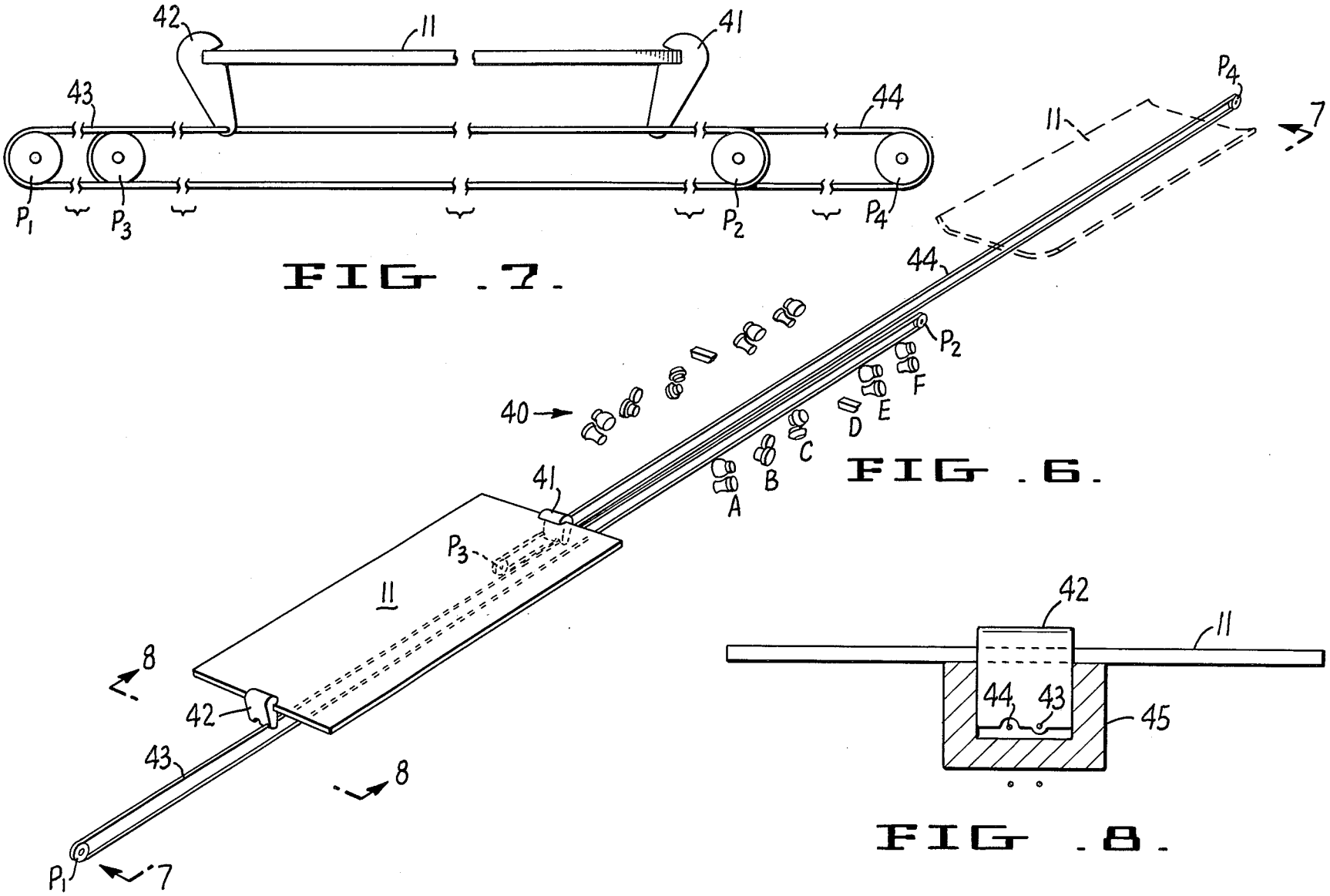
FIG. 6 is a schematic lay-out in perspective of a plate guide means for maintaining the plate in alignment during roll-forming.
FIG. 7 is an elevation view partly broken away taken along line 7—7 of FIG. 6 and looking in the direction of the arrows.
FIG. 8 is a fragmentary view partly in section of the trailing edge of a plate with the clamp of the guide means in place and positioned within an alignment slot.

It is to be understood that any standard form or roll-forming machine may be employed in the pre-forming and edge trimming process herein described. By such arrangements there are opposing rolls which operate simultaneously on each of the long edges of plate 11 as it passes through the roll-forming machine. These cooperating and simultaneous forming and working operations assist in keeping plate 11 aligned and in a straight path during its travel through the roll-forming, trimming and bevelling operations. Nevertheless to insure against misalignment and skewing of the plates a clamping and guide means is desirable for pre-crimping the edges. One form of such arrangement is shown in perspective and outlined in FIG. 6 wherein roll-form machine 40 with rolls, cutters, and planing tolls A, B, C, D, E and F as heretofore described are mounted.

In this arrangement plate 11 is held by opposing clamps 41 and 42 as the plate approaches machine 40 and continues to travel through it. After the preforming, trimming and other edge forming steps are completed, the clamps are released and the plate 11 continues on its travel in the direction of the arrow along standard runout tables.

Any type of latch or guiding means can be used. One form which is particularly advantageous for the operation of this invention is shown schematically in FIG. 7 which is a view in elevation partly broken away of plate 11 when held in alignment prior to entry into machine 40. As will be noted the clamps 41 and 42 and mounted on a system of pulleys and cables as described below. Pulleys P1 and P2 control cable 43 to which tail clamp 42 is attached and pulleys P3 and P4 control cable 44 to which lead clamp 41 is attached. Plate 11 engages clamp 41 prior to entering the machine and moves with the plate as the tension provided by cable 44 maintains a firm grip on the plate. Meanwhile, clamp 42 is pulled forward by cable 43 at a sufficient speed for the clamp to engage the trailing edge of plate 11 and at a sufficient tension to also maintain clamping pressure to firmly grip the plate and restrain it from lateral motion. This engagement is maintained as the plate passes through machine 40 and onto the runout that is located following the forming and trimming operation. The tension on the cables is thereafter released and the clamps disengage plate 11 and are returned to their original starting position for operation on successive plates entering the roll-forming machine.

To insure alignment of clamps 41 and 42 a channel guide 45 is provided along the length of the runout tables (not shown) and the roll-forming machine positioned between them and thereby prevent lateral movement of the clamping elements 41 and 42. As will be noted from FIG. 8 the flanges of channel guide 45 form a slot for the foregoing purpose.

Figure 5:
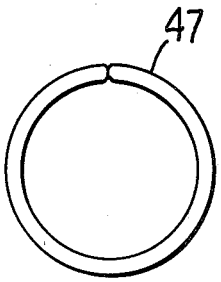
FIG. 5 is a view in section showing the final shape of the pipe to be formed from the edge preformed and trimmed plate of this invention after it has been subjected to U-ing and O-ing operations (not shown)
Figure 2G:
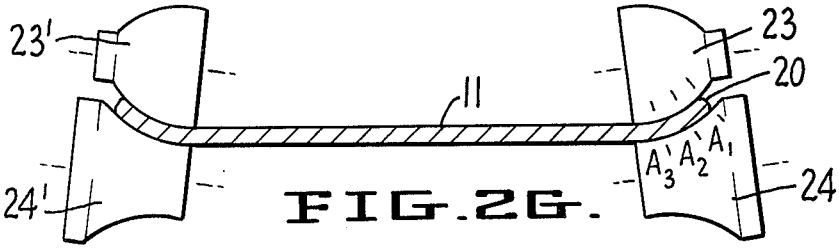

The present invention may be employed with any metal, but for obvious commercial reasons steel is the metal used in practically all instances and the grade of steel may vary depending on the service requirements for the pipe. Although the invention is particularly useful for thick gauge steel material of one inch or more and of a hardness normally used in forming large diameter U-O pipe made for oil and gas pipelines, it can also be used on sheet, strip or plate of greater or lesser gauge and of varying hardness or temper. Plates of several inches in thickness can be accurately precrimped. The system of the FIG. 2 series of drawings is particularly useful for very thick gauge plate. It can also be used in conjunction with other pipe making processes such as Electric Resistance Welding (E.R.W.), or High Frequency Welding (H.F.W.) whether from cut to length plates and sheets or continuous as formed coiled material such as is used in cage forming or continuous forming processes. FIG. 5 shows the final shape of a typical pipe 47 made by the U-O process.

In the final preform rolls following trimming and bevelling, additional rolls can be used if desired. Such rolls may be of the same or varying contours, so long as the final desired radius is obtained. Such multiple rolls can assist in obtaining the final radius in varying steps. However, in the case of small diameter pipe a single roll may be used.

It is to be understood that conventional driving means are utilized between the preforming and shearing and bevelling means heretofore described. Also, conventional conveyor tables and the like are used for delivering the plate sections to and from the preforming means.

The significance of the above-described edge preforming invention for flat metal sections, and particularly heavy gauge steel, can be more fully appreciated by comparison to a conventional heavy plate U-O pipe forming plant using edge planers are crimping presses. A conventional plant comprises expensive heavy presses for carrying out edge crimping operations. These crimping presses are massive stationary apparatus that apply great forces. Since large and expensive edge planing devices are required to plane and bevel the plate edges before they are crimped in the crimping presses, [the combination of the edge planer and crimping presses], the combination of the edge planer and crimping presses are expensive and bulky equipment which take up considerable space in a plant. In contrast to the foregoing, the roll-forming equipment used in the present invention to work the edges of plate, including plate of a thickness exceeding one inch, is far less complicated and expensive. Roller crimping, like presser crimping, has heretofore been impossible to carry out on thick plate to their extreme edges without leaving a narrow unbent width at the extreme edges without crushing the edges of the plate and reducing its thickness. This is likewise true for lesser thicknesses of steel grades that are much tougher and harder to form. However, when the edge of the plate is preformed before the excess material on the edges has been removed, such excess material is available for use as a lever arm to effect bending in the desired area adjacent to the edge of the material so that when the excess material which extends slightly into the bent area is removed, the remaining edges of the plate will be formed to the bitter edge. Since separating forces between forming rolls are greatly reduced by this method and all other edge preparation functions can be preformed simultaneously in the same machine, the resulting differences between edge forming of the U-O pipe by this invention as compared with other methods in use in the present era of heavy equipment costs represent difference in capital costs on the order of millions of dollars.

A significant unexpected advantage realized from this invention is that reductions in O-Press forming pressures of up to about 70 percent of that needed when there is no precrimping accurately to the bitter edges of the plate. Also, the precrimping and trimming substantially reduces the wear on the bottom rolls because of the elimination of sharp edges on the corners of the plates being worked.

Apart from the unique roll-forming and shearing means embodied herein, the process of this invention can be carried out on conventional roll-forming equipment. Minor modifications can be made by those skilled in the art without departing from the spirit and scope of the invention.

What is claimed is:

1. The process of preforming longitudinal edges of flat steel plate into a finished pipe of a specified diameter comprising roll-forming said plate while said plate is of sufficient excess width to provide material to serve as a lever arm during rolling, said roll forming commencing at points spaced from said edges thereof, which points approximate bitter edges of the plate width required for pipe of said specified diameter and including the step of applying sufficient rolling force and crimping said edges of said plate adjacent said points in a direction toward the center of said pipe to a radius approximating that required for said finished pipe while leaving a central area of said plate between said points essentially flat, and shearing said plate at said points to form said bitter edges.

2. The process of claim 1 wherein said points are spaced from said edges a distance at least equal to the thickness of said plate.

3. The process of claim 1 wherein said shearing step comprises a roll-shearing operation carried out during said roll-forming operation.

4. The process of claim 1 wherein said shearing step comprises a roll-shearing operation carried out after said step of roll-forming said edges.

5. The process of preforming longitudinal edges of flat steel plate prior to forming, pressing and welding said plate into a finished pipe of a specified diameter comprising roll-forming said plate while said plate is of sufficient excess width to provide material to serve as a lever arm during rolling, said roll-forming commencing at points spaced from said edges thereof and which points approximate bitter edges of the plate width required for pipe of said specified diameter and including the step of applying sufficient rolling force to bend said plate adjacent said points in a direction toward the center of said pipe to a radius approximating that required for said finished pipe, shearing said plate at said points to form said bitter edges, and further crimping said plate by roll-forming to thereby widen an area adjacent said bitter edges that is bent to said radius.

6. The process of claim 5 wherein said further crimping comprises two successive roll-forming steps each of which extend said preform edge areas for a distance in the direction of the center of said plate at least equal to said preform rolling at said bitter edges.

7. The process of preforming longitudinal edges of flat steel plate prior to forming, pressing and welding said plate into a finished pipe of a specified diameter comprising roll-forming edges of said plate while said plate is of sufficient excess width to provide material to serve as a lever arm during rolling, said roll-forming commencing at points spaced from said edges thereof and which points approximate bitter edges of the plate width required for pipe of said specified diameter and including the step of applying sufficient rolling force to bend and preform said plate adjacent said points in an area adjacent said edges of said plate in a direction toward the center of said pipe to a radius approximating that required for said finished pipe, shearing said plate at said points to form said bitter edges, bevelling and planishing said bitter edges, and further roll-forming said plate to thereby widen said area that is bent to said radius.

8. The process of claim 7 wherein said bevelling is carried out by rotary grinding.

9. The process of claim 7 wherein said bevelling is carried out by planishing.

* * * * *